United States Patent [19]

Miyajima et al.

[11] Patent Number: 4,913,651

[45] Date of Patent: Apr. 3, 1990

[54] BURNER UNIT FOR FIRING FURNACE

[75] Inventors: Toyoshiro Miyajima, Tajimi; Kazuhiro Miyahara, Nagoya, both of Japan

[73] Assignee: NGK Insulators, Ltd., Japan

[21] Appl. No.: 330,901

[22] Filed: Mar. 31, 1989

[30] Foreign Application Priority Data

Mar. 31, 1988 [JP] Japan ..... 63-42127[U]

[51] Int. Cl.[4] ..... F27B 5/14

[52] U.S. Cl. ..... 432/209; 431/202; 432/175; 432/213; 432/222; 432/146

[58] Field of Search ..... 432/222, 175, 182, 181, 432/180, 179, 146, 147, 202, 209; 431/202

[56] References Cited

U.S. PATENT DOCUMENTS

| | | | |
|---|---|---|---|
| 1,789,149 | 1/1931 | Machlet | 432/213 |
| 2,933,425 | 4/1960 | Hess | 432/146 |
| 3,020,032 | 2/1962 | Casey | 432/213 |
| 3,212,554 | 10/1965 | Blaha | 432/175 |
| 4,392,824 | 7/1983 | Struck et al. | 432/181 |
| 4,676,744 | 6/1987 | Wray et al. | 432/181 |

*Primary Examiner*—Henry C. Yuen

*Attorney, Agent, or Firm*—Arnold, White & Durkee

[57] ABSTRACT

A burner unit is used for firing, for example, formed ceramic bodies in a firing furnace. The burner unit includes a burner tile assembly provided in a furnace wall and a burner connected to the burner tile assembly and provided out of the firing furnace. The burner is integrally provided with a connecting burner tile assembly having a tapered step. The burner tile assembly is also provided with a tapered step. The tapered steps of the connecting burner tile assembly and the burner tile assembly are connected through a sealing material to connect the burner to the burner tile assembly. With this arrangement, the burner unit reduces heat dissipation due to a burner construction and enables maintenance to be effected during operation of the burner.

3 Claims, 2 Drawing Sheets

BURNER UNIT FOR FIRING FURNACE

BACKGROUND OF THE INVENTION

This invention relates to a burner unit for a firing furnace to be preferably used for firing, for example, formed ceramic bodies.

A burner unit as shown in a sectional and a side view of FIGS. 1*a* and 1*b* has been known using natural gases or the like as a fuel for firing formed ceramic bodies in a firing furnace.

As shown in FIGS. 1*a* and 1*b* in a furnace wall 21 made of a refractory material there is provided a burner tile assembly 22 and a burner 25 is bolted to the burner tile assembly 22 through a burner holder 24 and a front plate 23 provided on an outer surface of the burner tile assembly 22.

With such a burner unit, however, high temperature gases in the furnace tend to leak out of the furnace through connections between the burner tile assembly 22 and the furnace wall 21 and cracks in the wall and tiles. Therefore, the front plate 23 is often heated by the leaked high temperature gases to a red-heated state so that the heat in the furnace is dissipated uselessly.

Moreover, since the burner unit is fixed by bolts to the burner tile assembly 22 through the red-heated front plate 23, such a heated plate makes difficult maintenance of the furnace such as filling with ceramic fibers during operation of the burner 25'

SUMMARY OF THE INVENTION

It is a primary object of the invention to provide a burner unit for a firing furnace, which eliminates the disadvantages of the prior art and which reduces dissipation of heat in the furnace as much as possible and enables maintenance of the furnace to be effected in operation of the burner unit.

In order to achieves the object, in a burner unit for a firing furnace including a burner tile assembly provided in a furnace wall and a burner connected to the burner tile assembly and provided out of the firing furnace, according to the invention said burner is integrally provided with a connecting burner tile assembly having a tapered step, and said burner tile assembly is also provided with a tapered step, and said tapered steps of the connecting burner tile assembly and said burner tile assembly are connected through a sealing material to connect the burner to the burner tile assembly.

With the above construction, the burner and the burner tile assembly in the furnace wall are connected with each other by means of connecting burner tile assembly made of the refractory bricks integral with the burner without using any front plate made of a metal. In connecting them, moreover, the tapered steps adapted to be fitted with each other are provided at connecting surfaces of the burner tile assembly and connecting burner tile assembly. Therefore, any leakage of gases in the furnace can be reduced and red-heating is completely prevented which would otherwise occur at the front plate.

According to the invention, a seal material such as ceramic fibers is interposed between the connecting surfaces of the burner tile assembly and the connecting burner tile assembly. Since there is no red-heating in the burner unit according to the invention, the ceramic fibers as the sealing material can be replaced and retaining bolts for the connecting burner tile assembly can be tightened if they are inadvertently loosened in operation of the burner unit.

The invention will be more fully understood by referring to the following detailed specification and claims taken in connection with the appended drawings.

DETAILED EXPLANATION OF THE PREFERRED EMBODIMENT

Figure 1A:
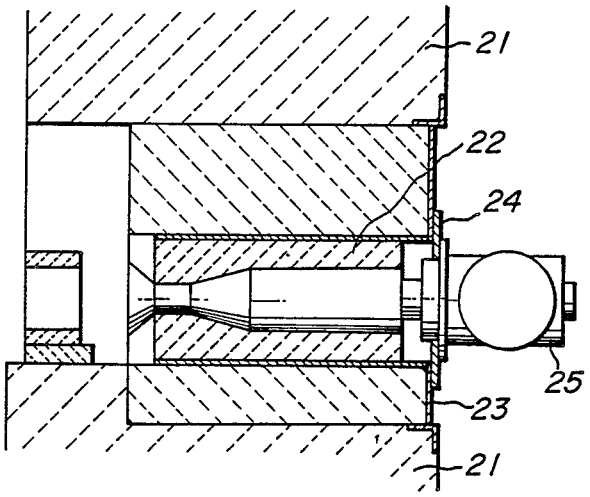
FIG 1a PRIOR ART
FIG. 1*a* is a partial sectional view illustrating one example of a burner unit for a firing furnace of the prior art.
Figure 1B:
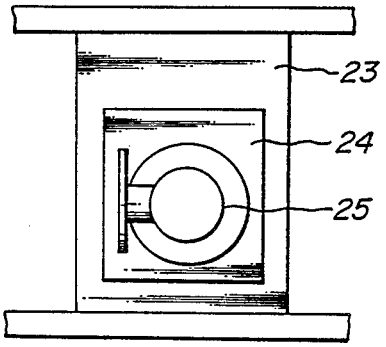
FIG 1b PRIOR ART
FIG. 1*b* is a side view of the burner shown in FIG. 1*a;*
Figure 2A:
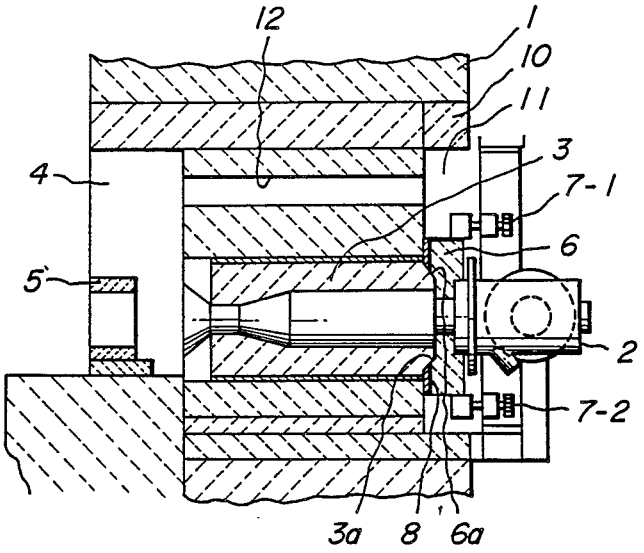
FIG. 2*a* is a partial sectional view illustrating one embodiment of the burner unit according to the invention.
Figure 2B:
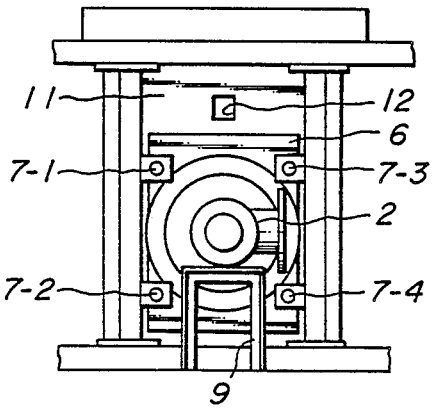
FIG. 2*b* is a side view of the burner unit shown in FIG. 2*a*.

One embodiment of the burner unit for a firing furnace according to the invention is shown in a partial sectional view and a side view of FIGS. 2*a* and 2*b*.

In the embodiment, a burner tile assembly 3 is provided in a furnace wall of the firing furnace for leading burnt gases from the burner 2, and a space 4 is provided inside of the burner tile assembly in the furnace. A Venturi tile assembly 5 is arranged in the space 4.

A connecting burner tile assembly 6 made of a refractory body integrally formed with the burner 2 is provided on an outer side of the burner tile assembly 3 and fixed thereto by retaining bolts 7-1 to 7-4. Sealing materials 8 made of ceramic fibers or the like are provided at contacting surfaces between the burner tile assembly 3 and the connecting burner tile assembly 6, while the contacting surfaces between the tile assemblies are connected by providing tapered steps 3*a* and 6*a* on the connecting surfaces adapted to be fitted with each other.

Moreover, the burner 2 is arranged on a burner support 9. Furthermore, the burner unit is displaced toward the inside of the furnace by a distance corresponding to a thickness of the connecting burner tile assembly 6 by a bridge brick assembly 10 to provide a space 11 in the furnace wall 1. The furnace wall 1 is formed above the burner tile assembly 3 with an aperture 12 for introducing a thermocouple for detecting temperatures in the furnace.

With the burner unit constructed as above described, any leakage of gases through connecting portions between the burner tile assembly 3 and furnace wall 1 by providing the tapered steps 3*a* and 6*a* on the connecting surface therebetween.

Moreover, by making the connecting burner tile assembly 6 from a refractory body such as refractory bricks made of alumina or the like in conjunction with the prevention of leakage of high temperature gases in the furnace, the red-heating is completely prevented so that useless heat dissipation resulting from the leakage of high temperature gases and hence the red-heating can be eliminated.

According to the invention, the connecting burner tile assembly 6 is fixed to the burner tile assembly 3 by means of retaining bolts 7-1 to 7-4. Therefore, for example, the sealing materials 8 made of ceramic fibers or the like can be replaced during operation of the burner 2 and the retaining bolts 7-1 to 7-4 for the connecting burner tile assembly 6 can be tightened if inadvertently loosened without stopping the operation of the burner unit.

It will of course be understood that various changes and modifications may be made in the invention without departing from the scope thereof. In the embodiment shown in FIGS. 2*a* and 2*b*, for example, configurations of the tapered steps 3*a* and 6*a* and the connecting burner tile assembly 6 and positions and numbers of the retaining bolts 7-1 to 7-4 may of course be changed.

As can be seen from the above explanation, according to the invention, the predetermined connecting burner tile assembly is provided between the burner tile assembly in the furnace wall and the burner and is fixed to the burner tile assembly in the furnace wall by retaining bolts. The burner unit according to the invention reduces heat dissipation due to a burner construction and enables maintenance to be effected during operation of the burner.

What is claimed is:

1. A burner unit for a firing furnace including a burner tile assembly provided in a furnace wall and a burner connected to the burner tile assembly and provided out of the firing furnace, wherein said burner unit is integrally provided with a connecting burner tile assembly having a tapered step, and said burner tile assembly is also provided with a tapered step, and said tapered steps of the connecting burner tile assembly and said burner tile assembly are connected through a sealing material to connect the burner to the burner tile assembly.

2. A burner unit for a firing furnace as set forth in claim 1, wherein a space is provided inside of the burner tile assembly and a Venturi tile assembly is provided in the space.

3. A burner unit for a firing furnace as set forth in claim 1, wherein said burner unit is displaced toward inside of the furnace by a distance corresponding to a thickness of the connecting burner tile assembly by a bridge brick assembly to provide a space in the furnace wall.

* * * * *